US010344345B2

(12) United States Patent
Tanaka et al.

(10) Patent No.: US 10,344,345 B2
(45) Date of Patent: Jul. 9, 2019

(54) PART OBTAINED FROM AGE HARDENING TYPE BAINITIC MICROALLOYED STEEL, PROCESS FOR PRODUCING PART, AND AGE HARDENING TYPE BAINITIC MICROALLOYED STEEL

(71) Applicant: DAIDO STEEL CO., LTD., Nagoya-shi, Aichi (JP)

(72) Inventors: Yuuki Tanaka, Aichi (JP); Takahiro Miyazaki, Aichi (JP); Ayumi Yamazaki, Aichi (JP); Yusuke Yoshimi, Aichi (JP); Hiroki Terada, Aichi (JP); Makoto Haritani, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 235 days.

(21) Appl. No.: 15/280,135

(22) Filed: Sep. 29, 2016

(65) Prior Publication Data

US 2017/0096720 A1 Apr. 6, 2017

(30) Foreign Application Priority Data

Oct. 2, 2015 (JP) ..... 2015-196645
Aug. 18, 2016 (JP) ..... 2016-160290

(51) Int. Cl.
*C21D 6/02* (2006.01)
*C21D 8/06* (2006.01)
(Continued)

(52) U.S. Cl.
CPC ..... *C21D 8/065* (2013.01); *C21D 6/004* (2013.01); *C21D 6/005* (2013.01); *C21D 6/008* (2013.01);
(Continued)

(58) Field of Classification Search
CPC .. C21D 2211/002; C21D 6/004; C21D 6/005; C21D 6/008; C21D 6/02; C21D 8/065;
(Continued)

(56) References Cited

U.S. PATENT DOCUMENTS 6,162,389 A * 12/2000 Hase ..... C22C 38/001 148/332
2009/0277539 A1* 11/2009 Kimura ..... C21D 8/0205 148/504
(Continued)

FOREIGN PATENT DOCUMENTS

JP 2011-236452 A 11/2011
JP 2015-180773 A 10/2015
WO 2051-133470 9/2015

OTHER PUBLICATIONS

Office Action issued in Chinese Patent Application No. 201610872440.5 dated Mar. 4, 2019 with English translation.

*Primary Examiner* — Veronica F Faison
(74) *Attorney, Agent, or Firm* — Greenblum & Bernstein, P.L.C.

(57) ABSTRACT

The present invention relates to a part obtained from an age hardening type bainitic microalloyed steel, a process for producing the part, and the age hardening type bainitic microalloyed steel. In particular, the present invention relates to a part which has been controlled so as to have higher values of strength than conventional parts, a process for producing the part, and the age hardening type bainitic microalloyed steel.

8 Claims, 3 Drawing Sheets

(51) Int. Cl.

| | |
|---|---|
| ***C21D 6/00*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/04*** | (2006.01) |
| ***C22C 38/02*** | (2006.01) |
| ***C22C 38/00*** | (2006.01) |
| ***C22C 38/54*** | (2006.01) |

(52) U.S. Cl.
CPC ..... *C21D 6/02* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01)

(58) Field of Classification Search
CPC ..... C22C 38/002; C22C 38/02; C22C 38/04; C22C 38/42; C22C 38/44; C22C 38/46; C22C 38/48; C22C 38/50; C22C 38/54
See application file for complete search history.

(56) References Cited

U.S. PATENT DOCUMENTS

2012/0288397 A1* 11/2012 Barbosa ..... C21D 1/02 420/106
2015/0354048 A1* 12/2015 Han ..... C22C 9/06 148/686
2017/0073785 A1 3/2017 Tanaka et al.

* cited by examiner

PART OBTAINED FROM AGE HARDENING TYPE BAINITIC MICROALLOYED STEEL, PROCESS FOR PRODUCING PART, AND AGE HARDENING TYPE BAINITIC MICROALLOYED STEEL

FIELD OF THE INVENTION

The present invention relates to a part obtained from an age hardening type bainitic microalloyed steel, a process for producing the part, and the age hardening type bainitic microalloyed steel. In particular, the present invention relates to a part which has been controlled so as to have higher values of strength than conventional parts, a process for producing the part, and the age hardening type bainitic microalloyed steel.

BACKGROUND OF THE INVENTION

Age hardening type bainitic microalloyed steels are a kind of steel configured so that the steel is soft when worked but increases in strength when heated, after the working, to a temperature not higher than a transformation temperature (age hardening treatment), without undergoing a heat-treatment strain. Consequently, such steels are being developed as microalloyed steels which combine strength and machinability. For example, the following Patent Documents 1 and 2 disclose such age hardening type bainitic microalloyed steels combining strength and machinability.

Patent Document 1: JP-A-2011-236452

Patent Document 2: JP-A-2015-180773

SUMMARY OF THE INVENTION

Meanwhile, mainly used as microalloyed steels are ferrite+pearlite type steels to which V has been added. At present, such steels are used as, for example, connecting rods for motor vehicles. As a result of recent needs for size reductions, the microalloyed steels for use as connecting rods, etc. have come to be required to have even higher strength, in particular, higher proof stress.

Although the ferrite+pearlite type steels attain high proof stress due to the inclusion of a large amount of V which is expensive, the proof stress thereof is about 850 MPa at the most. Such proof stress is insufficient in view of the levels required recently. The age hardening type bainitic microalloyed steels described in Patent Documents 1 and 2 come to have a proof stress of about 1,100 MPa, which is higher than that of the ferrite+pearlite type. That proof stress, however, is not always sufficient in view of the levels required recently.

With respect to connecting rods for motor vehicles, the so-called cracking connecting rods, which are produced by breaking separation processing in which a steel material is cracked (broken), are coming to be mainly used for the purpose of reducing the production cost. In the case of use for producing such cracking connecting rods, the steel materials are required to have lower toughness (low-impact-value properties), from the standpoint of facilitating the breaking separation.

The present invention has been achieved in order to overcome the problem. An object of the present invention is to provide a process for producing a part having even higher strength from an age hardening type bainitic microalloyed steel and a process for producing a part having not only high strength but also low toughness value (low impact value) from the microalloyed steel.

In order to achieve the above-mentioned object, the present invention relates to the following <1> to <7>.

<1> A process for producing a part from an age hardening type bainitic microalloyed steel, the age hardening type bainitic microalloyed steel including, in terms of mass %:

0.10-0.40% of C;
0.01-2.00% of Si;
0.10-3.00% of Mn;
0.001-0.150% of P;
0.001-0.200% of S;
0.001-2.00% of Cu;
up to 0.40% of Ni;
0.10-3.00, of Cr; and
at least one selected from:
0.02-2.00% of Mo;
0.02-2.00% of V;
0.001-0.250% of Ti; and
0.010-0.1000 of Nb, with the remainder being Fe and unavoidable impurities, and satisfying the following expression (1) and expression (2), the process including:

a non-thermal-refining forging step of subjecting the age hardening type bainitic microalloyed steel to hot forging;

an age hardening treatment step of subjecting the age hardening type bainitic microalloyed steel after the hot forging to age hardening treatment at a predetermined aging temperature within a range of 500-700° C.; and a strain age hardening treatment step of subjecting the age hardening type bainitic microalloyed steel during or after the age hardening treatment to strain age hardening treatment at a predetermined working temperature that is lower than the aging temperature and is within a range of 200-600° C. and at a reduction ratio of 3-35%:

$$3\times[C]+10\times[Mn]+2\times[Cu]+2\times[Ni]+12\times[Cr]+9\times[Mo]+2\times[V]\geq 20 \quad \text{expression (1);}$$

$$32\times[C]+3\times[Si]+3\times[Mn]+2\times[Ni]+3\times[Cr]+1\times[Mo]+32\times[V]+65\times[Ti]+36\times[Nb]\geq 24.0 \quad \text{expression (2),}$$

in which each [ ] in the expression (1) and the expression (2) indicates a content of the element shown therein in terms of mass %.

<2> The process for producing a part from an age hardening type bainitic microalloyed steel according to <1>, in which the age hardening type bainitic microalloyed steel further satisfies the following expression (3):

$$321\times[C]-31\times[Mo]+213\times[V]+545\times[Ti]+280\times[Nb]\geq 100 \quad \text{expression (3),}$$

in which each [ ] in the expression (3) indicates a content of the element shown therein in terms of mass %.

<3> The process for producing a part from an age hardening type bainitic microalloyed steel according to <1> or <2>, in which the age hardening type bainitic microalloyed steel further includes, in terms of mass %, at least one selected from:

0.0001-0.0100% of B;
0.001-0.300% of Pb;
0.001-0.300% of Bi;
0.001-0.300% of Te; and
0.001-0.010% of Ca.

<4> A part obtained by the process for producing a part from an age hardening type bainitic microalloyed steel according to any one of <1> to <3>.

<5> An age hardening type bainitic microalloyed steel including, in terms of mass %:

0.10-0.40% of C;
0.01-2.00% of Si;
0.10-3.00% of Mn;
0.001-0.150% of P;
0.001-0.200% of S;
0.001-2.00% of Cu;
up to 0.40% of Ni;
0.10-3.00% of Cr; and
at least one selected from:
0.02-2.00% of Mo;
0.02-2.00% of V;
0.001-0.250% of Ti; and
0.010-0.1000/0 of Nb, with the remainder being Fe and unavoidable impurities, and satisfying the following expression (1) and expression (2):

$$3\times[C]+10\times[Mn]+2\times[Cu]+2\times[Ni]+12\times[Cr]+9\times[Mo]+2\times[V]\geq 20 \quad \text{expression (1);}$$

$$32\times[C]+3\times[Si]+3\times[Mn]+2\times[Ni]+3\times[Cr]+1\times[Mo]+32\times[V]+65\times[Ti]+36\times[Nb]\geq 24.0 \quad \text{expression (2),}$$

in which each [ ] in the expression (1) and the expression (2) indicates a content of the element shown therein in terms of mass %.

<6> The age hardening type bainitic microalloyed steel according to <5>, further satisfying the following expression (3):

$$321\times[C]-31\times[Mo]+213\times[V]+545\times[Ti]+280\times[Nb]\geq 100 \quad \text{expression (3),}$$

in which each [ ] in the expression (3) indicates a content of the element shown therein in terms of mass %.

<7> The age hardening type bainitic microalloyed steel according to <5> or <6>, further including, in terms of mass %, at least one selected from:

0.0001-0.0100% of B;
0.001-0.300% of Pb;
0.001-0.300% of Bi;
0.001-0.300% of Te; and
0.001-0.010% of Ca.

The present inventors have found that relationships among component contents for attaining predetermined strength in parts produced from age hardening type bainitic microalloyed steels can be formulated as shown by expressions (1) and (2). The present inventors have further found that in cases when a strain age hardening treatment is added as one step to a production process, the part thus produced has even higher strength. Specifically, a part which, after a strain age hardening treatment, has a hardness of 33 HRC or higher and a proof stress of 900 MPa or higher can be obtained from an age hardening type bainitic microalloyed steel.

Furthermore, the present inventors have found that a relationship among component contents which is for attaining low toughness can be formulated as shown by expression (3). Namely, by giving a strain age hardening treatment to an age hardening type bainitic microalloyed steel which satisfies expressions (1) to (3), a part which, after the strain age hardening treatment, has a hardness of 33 HRC or higher and a proof stress of 900 MPa or higher and which has a room-temperature Charpy impact value (2-mm U) of 30 J/cm$^2$ or less can be obtained from the age hardening type bainitic microalloyed steel.

DETAILED DESCRIPTION OF THE INVENTION

Figure 1:
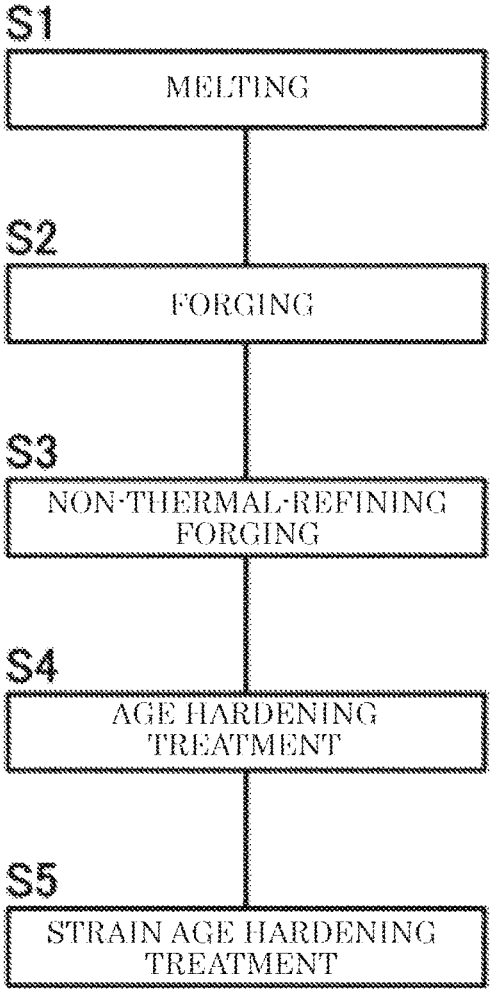
FIG. 1 is a flowchart which illustrates a process for producing a part from an age hardening type bainitic microalloyed steel according to the present invention.

The reasons and conditions for the limitation of the content of each element in the age hardening type bainitic microalloyed steel which is used for producing a part of the present invention are explained below.

(1) C: 0.10-0.40%

C is an element necessary for ensuring strength. C serves to precipitate carbides of Mo, V, Ti, and Nb through an age hardening treatment to enhance the strength of the steel. Furthermore, C contributes also to an increase in strength through strain age hardening. For attaining such functions, it is necessary that C should be contained in an amount of 0.10% or more. Meanwhile, in case where C is contained in too large an amount exceeding 0.40%, this results in a deterioration in machinability. Consequently, an upper limit of the C content is 0.40%. The C content is preferably 0.15-0.35%.

(2) Si: 0.01-2.00%

Si is added not only as a deoxidizer during melting for steel production but also for the purpose of strength improvement. For these functions, it is necessary that Si should be contained in an amount of 0.01% or more. Meanwhile, in case where Si is contained in too large an amount exceeding 2.00%, this is a cause of a decrease in the life of the die used for hot forging, resulting in an increase in production cost. Consequently, an upper limit of the Si content is 2.00%. The Si content is preferably 0.10-1.00%.

(3) Mn: 0.10-3.00%

Mn is an element effective for ensuring quenchability (ensuring bainite structures), improving the strength, and improving the machinability (MnS crystallization). It is hence necessary that Mn should be contained in an amount of 0.10% or more. However, in case where Mn is contained in too large an amount exceeding 3.00%, this accelerates the formation of martensite, leading to a deterioration in machinability. Consequently, an upper limit of the Mn content is 3.00%. The Mn content is preferably 0.50-2.500%.

(4) P: 0.001-0.150%

P is present unavoidably in the steel and the inclusion thereof is permissible. However, in case where P is contained in too large an amount exceeding 0.150%, it is difficult to control the steel so as to attain a reduction in impact value. Consequently, an upper limit of the P content is 0.150%. Incidentally, it has been ascertained that so long as the addition amount of P is 0.050%, or less in bainite structures, P does not affect the impact properties.

(5) S: 0.001-0.200%

It is necessary that S should be incorporated in an amount of 0.001% or more in order to ensure machinability. However, in case where S is contained in too large an amount exceeding 0.200%, this is a cause of a deterioration in producibility. Consequently, an upper limit of the S content is 0.200%. The S content is preferably 0.010-0.120%.

(6) Cu: 0.001-2.00%

Cu is incorporated in order to ensure quenchability (ensure bainite structures) and improve the strength. In case where Cu is contained in too large an amount exceeding 2.00%, this results in an increase in cost and is a cause of a deterioration in producibility. Consequently, an upper limit of the Cu content is 2.0/0. The Cu content is preferably 0.05-1.0/0, more preferably 0.10-0.50%.

(7) Ni: up to 0.40%

Ni may be incorporated in order to ensure quenchability (ensure bainite structures) and improve the strength, as in the case of Cu. However, since incorporation of Ni leads to an increase in cost, it is necessary to regulate the content thereof to 0.40% or less. The Ni content is preferably 0.05-0.20%.

(8) Cr: 0.10-3.00%

Cr is incorporated in order to ensure quenchability (ensure bainite structures) and improve the strength. For attaining these functions, it is necessary that Cr should be contained in an amount of 0.10% or more. However, in case where Cr is contained in too large an amount exceeding 3.00%, this not only results in an increase in cost but also accelerates the formation of martensite, leading to a deterioration in machinability. Consequently, an upper limit of the Cr content is 3.00%. The Cr content is preferably 0.20-1.50%.

At least one selected from:

Mo: 0.02-2.00%;

V: 0.02-2.00%;

Ti: 0.001-0.250%; and

Nb: 0.010-0.100%.

(9) Mo: 0.02-2.00%

Mo serves to precipitate Mo carbides through an age hardening treatment. Mo is preferably incorporated in order to enhance the strength through precipitation strengthening due to Mo carbides. For attaining this function, it is preferable that Mo is contained in an amount of 0.02% or more. However, in case where Mo is contained in too large an amount exceeding 2.00%, this results in an increase in cost. Consequently, an upper limit of the Mo content is 2.00%. The Mo content is more preferably 0.10-2.00%, further preferably 0.30-1.00%.

(10) V: 0.02-2.00%

V precipitates V carbides through an age hardening treatment. V is preferably incorporated in order to enhance the strength through precipitation strengthening due to V carbides. For attaining this function, it is preferable that V is contained in an amount of 0.02% or more. However, in case where V is contained in too large an amount exceeding 2.00%, this results in an increase in cost. Consequently, an upper limit of the V content is 2.00%. The V content is more preferably 0.10-2.00° %, further preferably 0.20-1.00%.

(11) Ti: 0.001-0.250%

Ti precipitates Ti carbides through an age hardening treatment. Ti is preferably incorporated in order to enhance the strength through precipitation strengthening due to T carbides. For attaining this function, it is preferable that Ti is contained in an amount of 0.001% or more. However, in case where Ti is contained in too large an amount exceeding 0.250%, this leads to a deterioration in machinability. Consequently, an upper limit of the Ti content is 0.250%. The Ti content is more preferably 0.005-0.200%, further preferably 0.01-0.10%.

(12) Nb: 0.010-0.100%

Nb precipitates Nb carbides through an age hardening treatment. Nb is preferably incorporated in order to enhance the strength though precipitation strengthening due to Nb carbides. For attaining this function, it is preferable that Nb is contained in an amount of 0.010% or more. However, in case where Nb is contained in too large an amount exceeding 0.100%, this results in an increase in cost. Consequently, an upper limit of the Nb content is 0.100%. The Nb content is more preferably 0.020-0.070%.

In the present invention, the following elements can be further added.

(13) B: 0.0001-0.0100%

B precipitates Fe carbides during forming. Since B has the effect of lowering the toughness by the precipitation of Fe carbides, B may be incorporated from the standpoint of low impact value. For attaining this function, B may be incorporated in an amount of 0.0001% or more. However, in case where B is contained in too large an amount exceeding 0.0100%, this results in an increase in cost. Consequently, an upper limit of the B content is 0.0100%. The B content is preferably 0.0010-0.0050%.

(14) Pb: 0.001-0.300%

Bi: 0.001-0.300%

Te: 0.001-0.300%

Ca: 0.001-0.010%

These elements can be incorporated as free-cutting elements according to need. However, too high contents thereof result in decreases in strength and hot workability. Consequently, an upper limit of each of the Pb, Bi and Te contents is 0.300%, and an upper limit of the Ca content is 0.010%.

(15) Remainder: Fe and Unavoidable Impurities

In Table 1, the contents of Fe and unavoidable impurities are omitted.

(16) To Satisfy the Following Expression (1)

$$3\times[C]+10\times[Mn]+2\times[Cu]+2\times[Ni]+12\times[Cr]+9\times[Mo]+2\times[V]\geq 20 \quad \text{expression (1);}$$

Expression (1) is a conditional expression serving as an index to the areal proportion of bainite. By regulating the contents (mass %) of C, Mn, Cu, Ni, Cr, Mo, and V so as to satisfy expression (1), the areal proportion of bainite in the structure of the steel before an age hardening treatment can be set at 85% or higher. It is prerequisite in the present invention that the structure of the steel which has undergone hot forging should be constituted substantially of a bainite phase alone.

(17) To Satisfy the Following Expression (2)

$$32\times[C]+3\times[Si]+3\times[Mn]+2\times[Ni]+3\times[Cr]+1\times[Mo]+32\times[V]+65\times[Ti]+36\times[Nb]\geq 24.0 \quad \text{expression (2)}$$

Expression (2) is a conditional expression serving as an index to the hardness of the steel which has undergone an age hardening treatment. The higher the contents of Mo, V, Ti, and Nb, which precipitate carbides through an age hardening treatment, the higher the hardness of the age-hardened steel. By regulating the contents (mass %) of C, Si, Mn, Ni, Cr, Mo, V. Ti, and Nb so as to satisfy expression (2), the hardness after an age hardening treatment can be set at 30 HRC or higher.

(18) In the present invention, the age hardening type bainitic microalloyed steel can be made to further satisfy the following expression (3).

$$321\times[C]-31\times[Mo]+213\times[V]+545\times[Ti]+280\times[Nb]\geq 100 \quad \text{expression (3)}$$

Expression (3) is a conditional expression serving as an index to Charpy impact value. Among the elements which precipitate carbides through an age hardening treatment, Mo acts so as to contribute to toughness enhancement, while V, Ti, and Nb act so as to contribute to toughness reduction. By regulating the contents (mass %) of C, Mo, V, Ti, and Nb so as to satisfy expression (3), the Charpy impact value (2-mm U) can be set at 30 J/cm$^2$ or less.

(19) Age Hardening Treatment at Predetermined Temperature within the Range of 500-700° C.

By subjecting an aging treatment at a temperature of 500-700° C. under the conditions of, for example, 0.5-4 hours, a part having a hardness of 30 HRC or higher can be obtained. A more preferred range of the aging temperature is 550-675° C., and a more preferred range of the aging period is 2-3 hours.

(20) Strain Age Hardening Treatment at Predetermined Working Temperature that is Lower than the Aging Temperature and within the Range of 200-600° C.

The reason why the working temperature is lower than the aging temperature is that in case where the working temperature is higher than the aging temperature, there is a concern of resulting in a decrease in hardness. Meanwhile, the reasons for the range of 200-600° C. are that temperatures lower than 200° C. may result in the occurrence of a crack in the part, while working temperatures higher than 600° C. make it difficult to obtain a hardness of 33 HRC or higher (see FIG. 3). A more preferred range of the working temperature is 300-500° C.

(21) Strain Age Hardening Treatment at Reduction Ratio of 3-35%

Figure 4:
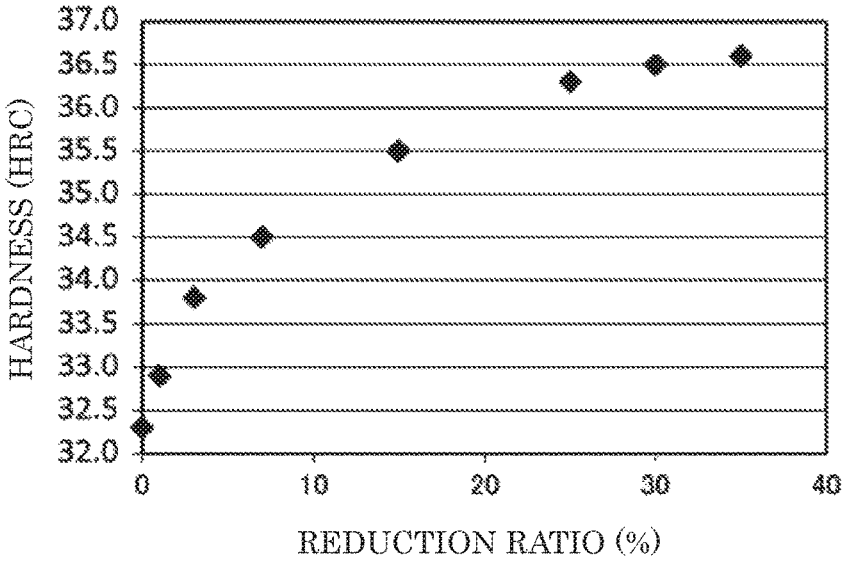
FIG. 4 is a graph which shows a relationship between reduction ratio in the strain age hardening treatment and hardness.

The reasons for the reduction ratio of 3-35% are that reduction ratios less than 3% make it extremely difficult to obtain a hardness of 33 HRC or higher, while even when the reduction ratio is increased beyond 35%, the degree of contribution of the working to the amount of hardening cannot be heightened any more (see FIG. 4). A more preferred range of the reduction ratio is 7-25%.

EXAMPLES

Examples of the present invention are explained below by reference to FIG. 1.

First, steel materials respectively having the chemical compositions shown in Table 1 (the remainder being Fe and unavoidable impurities) were melted in an amount of 150 kg each with a vacuum induction melting furnace (step S1), and were drawn with forging at 1,250° C. into round bars having a diameter of 50 mm (hot forging: step S2).

TABLE 1

(mass %)

| | | C | Si | Mn | P | S | Cu | Ni | Cr | Mo | V | Ti | Nb | Others |
|---|---|---|---|---|---|---|---|---|---|---|---|---|---|---|
| Example | 1 | 0.10 | 0.40 | 1.80 | 0.015 | 0.042 | 0.11 | 0.10 | 0.67 | 0.32 | 0.30 | 0.007 | 0.000 | — |
| | 2 | 0.10 | 0.02 | 2.01 | 0.015 | 0.051 | 0.01 | 0.09 | 1.00 | 0.60 | 0.35 | 0.002 | 0.000 | — |
| | 3 | 0.14 | 0.22 | 0.65 | 0.015 | 0.052 | 0.12 | 0.09 | 0.20 | 1.94 | 0.35 | 0.002 | 0.000 | — |
| | 4 | 0.11 | 1.98 | 1.68 | 0.002 | 0.020 | 0.15 | 0.10 | 0.13 | 0.54 | 0.32 | 0.002 | 0.000 | — |
| | 5 | 0.12 | 0.20 | 2.93 | 0.008 | 0.034 | 0.13 | 0.01 | 0.22 | 0.60 | 0.35 | 0.002 | 0.000 | — |
| | 6 | 0.10 | 0.18 | 1.40 | 0.120 | 0.060 | 0.12 | 0.08 | 0.82 | 0.88 | 0.37 | 0.002 | 0.000 | — |
| | 7 | 0.17 | 0.23 | 0.14 | 0.015 | 0.058 | 0.11 | 0.07 | 1.82 | 0.41 | 0.27 | 0.000 | 0.000 | — |
| | 8 | 0.20 | 0.40 | 1.01 | 0.007 | 0.002 | 0.12 | 0.05 | 1.42 | 0.52 | 0.24 | 0.000 | 0.000 | — |
| | 9 | 0.16 | 0.45 | 0.98 | 0.008 | 0.063 | 1.93 | 0.39 | 0.85 | 0.37 | 0.27 | 0.000 | 0.000 | — |
| | 10 | 0.15 | 0.28 | 1.01 | 0.008 | 0.195 | 0.11 | 0.08 | 1.30 | 0.41 | 0.27 | 0.000 | 0.000 | — |
| | 11 | 0.18 | 0.34 | 0.16 | 0.009 | 0.007 | 0.12 | 0.07 | 2.93 | 0.65 | 0.29 | 0.000 | 0.000 | — |
| | 12 | 0.12 | 0.41 | 0.69 | 0.010 | 0.020 | 0.12 | 0.07 | 0.65 | 0.30 | 1.84 | 0.000 | 0.000 | — |
| | 13 | 0.21 | 0.26 | 1.43 | 0.007 | 0.015 | 0.15 | 0.10 | 0.20 | 0.40 | 0.11 | 0.240 | 0.000 | — |
| | 14 | 0.22 | 0.39 | 1.02 | 0.019 | 0.102 | 0.14 | 0.09 | 0.85 | 0.31 | 0.20 | 0.002 | 0.100 | — |
| | 15 | 0.30 | 0.39 | 0.51 | 0.010 | 0.059 | 0.12 | 0.08 | 0.65 | 0.60 | 0.40 | 0.102 | 0.000 | — |
| | 16 | 0.15 | 0.30 | 1.90 | 0.020 | 0.062 | 0.12 | 0.09 | 0.65 | 0.26 | 0.38 | 0.007 | 0.000 | — |
| | 17 | 0.18 | 0.45 | 1.90 | 0.007 | 0.020 | 0.20 | 0.15 | 0.40 | 0.17 | 0.37 | 0.012 | 0.000 | — |
| | 18 | 0.18 | 0.70 | 1.92 | 0.025 | 0.008 | 0.25 | 0.20 | 0.35 | 0.10 | 0.20 | 0.102 | 0.000 | — |
| | 19 | 0.12 | 0.20 | 2.20 | 0.029 | 0.060 | 0.15 | 0.10 | 0.30 | 0.18 | 0.32 | 0.007 | 0.000 | — |
| | 20 | 0.16 | 0.20 | 2.50 | 0.031 | 0.020 | 0.16 | 0.10 | 0.45 | 0.32 | 0.39 | 0.008 | 0.000 | — |
| | 21 | 0.13 | 0.25 | 1.50 | 0.015 | 0.020 | 0.15 | 0.10 | 0.40 | 0.18 | 0.32 | 0.070 | 0.000 | — |
| | 22 | 0.22 | 0.20 | 1.50 | 0.007 | 0.005 | 0.15 | 0.15 | 0.15 | 0.40 | 0.25 | 0.070 | 0.000 | — |
| | 23 | 0.22 | 0.20 | 1.30 | 0.010 | 0.021 | 0.15 | 0.15 | 0.15 | 0.40 | 0.25 | 0.007 | 0.040 | Te: 00030 |
| | 24 | 0.18 | 0.40 | 1.19 | 0.011 | 0.048 | 0.12 | 0.09 | 0.65 | 0.80 | 0.40 | 0.007 | 0.000 | — |
| | 25 | 0.19 | 0.40 | 1.20 | 0.052 | 0.050 | 0.12 | 0.09 | 0.65 | 0.80 | 0.40 | 0.008 | 0.000 | Ca: 0.0024 |
| | 26 | 0.22 | 0.40 | 0.29 | 0.010 | 0.050 | 0.12 | 0.09 | 0.65 | 1.50 | 0.41 | 0.007 | 0.000 | — |
| | 27 | 0.30 | 0.40 | 0.99 | 0.010 | 0.050 | 0.12 | 0.09 | 0.65 | 0.49 | 0.40 | 0.008 | 0.000 | Pb: 0.14 |
| | 28 | 0.14 | 0.25 | 1.10 | 0.009 | 0.020 | 0.15 | 0.10 | 1.30 | 0.15 | 0.35 | 0.035 | 0.000 | B: 0.0020 |
| | 29 | 0.26 | 0.40 | 0.99 | 0.011 | 0.051 | 0.12 | 0.09 | 0.66 | 0.81 | 0.41 | 0.007 | 0.000 | — |
| | 30 | 0.17 | 0.40 | 0.50 | 0.010 | 0.020 | 0.12 | 0.09 | 1.52 | 0.80 | 0.41 | 0.007 | 0.000 | Bi: 0.14 |
| | 31 | 0.17 | 0.41 | 1.50 | 0.009 | 0.020 | 0.15 | 0.11 | 0.40 | 0.00 | 0.41 | 0.008 | 0.000 | — |
| | 32 | 0.25 | 0.50 | 2.10 | 0.011 | 0.030 | 0.14 | 0.11 | 1.00 | 0.65 | 0.00 | 0.090 | 0.000 | — |
| | 33 | 0.23 | 0.65 | 1.95 | 0.012 | 0.029 | 0.15 | 0.09 | 1.10 | 0.50 | 0.30 | 0.000 | 0.000 | — |
| | 34 | 0.38 | 0.41 | 2.05 | 0.013 | 0.028 | 0.14 | 0.09 | 1.10 | 0.49 | 0.00 | 0.000 | 0.000 | — |
| | 35 | 0.24 | 0.66 | 1.85 | 0.011 | 0.030 | 0.14 | 0.09 | 0.50 | 0.00 | 0.41 | 0.000 | 0.000 | — |
| | 36 | 0.29 | 0.35 | 1.51 | 0.010 | 0.021 | 0.15 | 0.15 | 0.15 | 0.51 | 0.31 | 0.007 | 0.040 | — |
| | 37 | 0.20 | 0.40 | 1.01 | 0.007 | 0.002 | 0.12 | 0.05 | 1.42 | 0.52 | 0.24 | 0.000 | 0.000 | — |
| | 38 | 0.30 | 0.39 | 0.51 | 0.010 | 0.059 | 0.12 | 0.08 | 0.65 | 0.60 | 0.40 | 0.102 | 0.000 | — |
| | 39 | 0.22 | 0.20 | 1.50 | 0.007 | 0.005 | 0.15 | 0.15 | 0.15 | 0.40 | 0.25 | 0.070 | 0.000 | — |
| Comparative Example | 1 | 0.14 | 0.20 | 1.95 | 0.007 | 0.020 | 0.15 | 0.10 | 0.65 | 0.00 | 0.12 | 0.007 | 0.000 | — |
| | 2 | 0.08 | 0.20 | 2.40 | 0.010 | 0.020 | 0.15 | 0.10 | 0.35 | 0.15 | 0.32 | 0.007 | 0.000 | — |
| | 3 | 0.13 | 0.15 | 2.15 | 0.015 | 0.020 | 0.02 | 0.02 | 0.30 | 0.16 | 0.30 | 0.005 | 0.000 | — |
| | 4 | 0.29 | 0.40 | 1.00 | 0.015 | 0.005 | 0.15 | 0.10 | 0.25 | 0.20 | 0.23 | 0.007 | 0.000 | — |
| | 5 | 0.14 | 0.20 | 3.50 | 0.019 | 0.020 | 0.12 | 0.20 | 0.80 | 0.40 | 0.32 | 0.007 | 0.000 | — |
| | 6 | 0.12 | 0.15 | 0.70 | 0.020 | 0.020 | 0.12 | 0.10 | 3.40 | 0.37 | 0.33 | 0.007 | 0.000 | — |
| Reference Example | 1 | 0.13 | 0.22 | 1.80 | 0.010 | 0.020 | 0.12 | 0.20 | 0.34 | 0.20 | 0.35 | 0.007 | 0.000 | — |
| | 2 | 0.12 | 0.19 | 1.93 | 0.014 | 0.015 | 0.11 | 0.10 | 0.25 | 0.35 | 0.40 | 0.007 | 0.000 | — |

Thereafter, the round bars having a diameter of 50 mm were each heated to 1,250° C., forged into a round bar with a diameter of 30 mm under the forging conditions of 1,100° C., and then air-cooled to room temperature (for example, at a cooling rate of 1.0° C./s) (non-thermal-refining forging: step S3). After the step S3, an age hardening treatment was performed at a predetermined aging temperature within the range of 480-720° C. under the conditions of 2 hours (step S4). In this age hardening treatment, a heat treatment at the above-described aging temperature for 2 hours was performed, followed by air-cooling to room temperature. After the step S4, a strain age hardening treatment was performed at a working temperature of 400° C. under the conditions of a reduction ratio of 15% (step S5).

Figure 2:
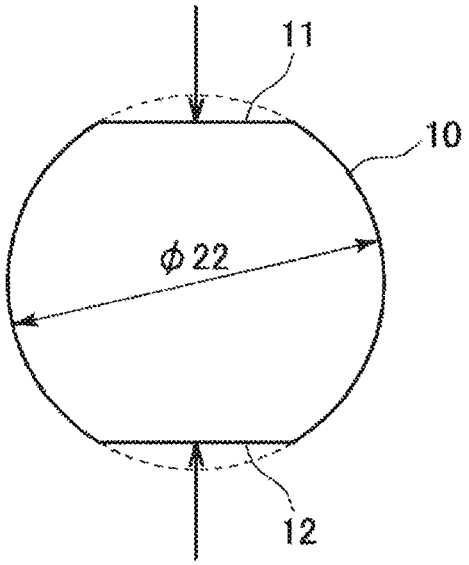
FIG. 2 is a front view which shows one example of test specimens to be subjected to a strain age hardening treatment.

In the strain age hardening treatment (step S5), test specimens such as that shown in, for example, FIG. 2 were used. These test specimens were each obtained, for example, by cutting a cylindrical rod of 22 mm (diameter)×about 100 mm out of the round bar and cutting lateral peripheral portions thereof located respectively on both sides of the center, thereby forming cut surfaces 11 and 12. The distance between the cut surfaces 11 and 12 was set at 18 mm. Thereafter, the cut surfaces 11 and 12 were compressed by forging. In cases when this test specimen is worked at a reduction ratio of 15%, the distance between the cut surfaces 11 and 12 after the working is 15.3 mm (=18 mm×(1−0.15)).

Each steel material which had undergone the step S3 was subjected to a hardness test and a microstructure examination, the steel material which had undergone the step S4 was subjected to the hardness test and a Charpy impact test, and the steel material which had undergone the step S5 was subjected to the hardness test. The hardness test, microstructure examination, and Charpy impact test were conducted respectively in the following manners.

(Hardness Test)

The hardness test was conducted in accordance with JIS Z 2245:2011 using a Rockwell hardness meter and a conical diamond indenter with a load of 150 kgf. The hardness measurement was made on (radius)×½ portions of each test specimen.

(Microstructure Examination)

In the microstructure examination, each test specimen was subjected to Nital corrosion and then examined with an optical microscope (magnification: 400 times) to determine the areal proportion of bainite structures (hereinafter referred to as "areal proportion of bainite"). The evaluation shown in Table 2 is as follows: the case where the areal proportion of bainite was 85% or higher is indicated by "○"; the case where the steel was a mixture of bainite structures and ferrite structures (areal proportion of ferrite structures: 15% or higher) is indicated by "×F"; and the case where the steel was a mixture of bainite structures and martensite structures (areal proportion of martensite structures: 15% or higher) is indicated by "×M". In Table 2, the actually measured areal proportions of bainite are also shown in the parentheses together with those evaluation results.

(Tensile Test)

With respect to tensile test, JIS Z2201 No. 14A test specimens each having a parallel-portion diameter of 5 mm and equipped with an M10 threaded portion were produced from each test material which had undergone the strain age hardening treatment. These test specimens were examined for 0.2% proof stress (hereinafter referred to simply as proof stress). Whether or not the proof stress satisfied the required value of 900 MPa or more was assessed.

TABLE 2

| | | Expression (1) | Expression (2) | Expression (3) | Microstructure (areal proportion of bainite) | Hardness before aging (HRC) | Hardness after aging (HRC) | Hardness after strain aging (HRC) |
|---|---|---|---|---|---|---|---|---|
| Example | 1 | 30.2 | 25.6 | 90 | ○ (100%) | 28.1 | 33.0 | 35.4 |
| | 2 | 38.7 | 30.4 | 89 | ○ (100%) | 32.3 | 36.9 | 39.2 |
| | 3 | 27.9 | 40.5 | 60 | ○ (100%) | 32.4 | 43.0 | 45.5 |
| | 4 | 24.7 | 31.4 | 88 | ○ (100%) | 34.4 | 37.4 | 39.8 |
| | 5 | 38.7 | 31.8 | 96 | ○ (100%) | 34.3 | 38.1 | 40.7 |
| | 6 | 33.2 | 32.2 | 85 | ○ (100%) | 37.7 | 41.2 | 43.4 |
| | 7 | 28.3 | 25.3 | 99 | ○ (100%) | 27.8 | 33.2 | 36.5 |
| | 8 | 33.2 | 28.4 | 99 | ○ (100%) | 33.0 | 36.2 | 39.6 |
| | 9 | 29.0 | 25.5 | 97 | ○ (100%) | 33.9 | 36.1 | 39.3 |
| | 10 | 30.8 | 25.9 | 93 | ○ (100%) | 28.7 | 33.5 | 36.2 |
| | 11 | 44.1 | 32.6 | 99 | ○ (100%) | 37.0 | 40.6 | 43.9 |
| | 12 | 21.8 | 71.4 | 421 | ○ (100%) | 36.2 | 39.9 | 42.5 |
| | 13 | 21.7 | 36.1 | 209 | ○ (100%) | 31.7 | 42.3 | 45.3 |
| | 14 | 24.7 | 27.5 | 133 | ○ (100%) | 30.3 | 36.4 | 39.5 |
| | 15 | 20.4 | 40.4 | 218 | ○ (100%) | 34.2 | 42.1 | 45.3 |
| | 16 | 30.8 | 29.0 | 125 | ○ (100%) | 30.6 | 32.8 | 35.6 |
| | 17 | 27.3 | 28.8 | 138 | ○ (100%) | 30.1 | 35.1 | 38.4 |
| | 18 | 26.1 | 29.3 | 153 | ○ (100%) | 32.6 | 38.7 | 41.7 |
| | 19 | 28.7 | 24.8 | 105 | ○ (100%) | 25.6 | 32.1 | 35.1 |
| | 20 | 35.1 | 31.3 | 128 | ○ (100%) | 32.1 | 37.3 | 40.1 |
| | 21 | 23.0 | 27.6 | 142 | ○ (100%) | 24.3 | 31.0 | 34.0 |
| | 22 | 22.2 | 29.8 | 149 | ○ (94%) | 29.4 | 33.9 | 36.8 |
| | 23 | 20.2 | 26.6 | 126 | ○ (85%) | 27.2 | 31.1 | 34.5 |
| | 24 | 28.7 | 34.6 | 120 | ○ (100%) | 31.5 | 39.0 | 42.5 |
| | 25 | 28.8 | 35.0 | 124 | ○ (100%) | 33.6 | 40.1 | 43.4 |
| | 26 | 26.1 | 41.2 | 112 | ○ (100%) | 32.9 | 36.8 | 39.6 |
| | 27 | 24.2 | 34.5 | 170 | ○ (100%) | 33.8 | 39.9 | 43.4 |
| | 28 | 29.6 | 27.8 | 134 | ○ (100%) | 28.9 | 32.6 | 35.7 |
| | 29 | 27.1 | 37.1 | 149 | ○ (100%) | 34.8 | 41.2 | 44.2 |
| | 30 | 32.2 | 35.3 | 121 | ○ (100%) | 33.5 | 39.3 | 42.2 |
| | 31 | 21.7 | 26.2 | 146 | ○ (91%) | 28.2 | 30.6 | 33.8 |
| | 32 | 40.1 | 32.0 | 109 | ○ (100%) | 33.1 | 35.1 | 38.1 |

TABLE 2-continued

| | | Expression (1) | Expression (2) | Expression (3) | Microstructure (areal proportion of bainite) | Hardness before aging (HRC) | Hardness after aging (HRC) | Hardness after strain aging (HRC) |
|---|---|---|---|---|---|---|---|---|
| | 33 | 39.0 | 33.7 | 122 | ○ (100%) | 32.0 | 37.1 | 40.5 |
| | 34 | 39.7 | 28.4 | 107 | ○ (100%) | 31.1 | 33.0 | 36.1 |
| | 35 | 26.5 | 30.0 | 164 | ○ (100%) | 30.1 | 33.8 | 36.9 |
| | 36 | 23.6 | 33.0 | 147 | ○ (100%) | 32.1 | 37.1 | 40.5 |
| | 37 | 33.2 | 28.4 | 99 | ○ (100%) | 33.0 | — | 39.9 |
| | 38 | 20.4 | 40.4 | 218 | ○ (100%) | 34.2 | — | 45.1 |
| | 39 | 22.2 | 29.8 | 149 | ○ (94%) | 29.4 | — | 37.2 |
| Comparative Example | 1 | 28.5 | 17.4 | 74 | ○ (100%) | 27.1 | 26.7 | 30.1 |
| | 2 | 30.9 | 24.0 | 93 | ○ (100%) | 24.9 | 30.5 | 33.7 |
| | 3 | 27.6 | 23.7 | 103 | ○ (100%) | 22.3 | 29.2 | 32.1 |
| | 4 | 16.6 | 24.4 | 139 | ×F (70%) ferrite formation | 27.4 | 28.9 | 31.9 |
| | 5 | 49.9 | 33.5 | 104 | ×M (83%) manensite formation | 37.5 | 40.1 | 42.9 |
| | 6 | 52.6 | 31.9 | 101 | ×M (78%) martensite formation | 41.3 | 43.5 | 46.7 |
| Reference Example | 1 | 25.6 | 25.5 | 114 | ○ (100%) | 27.6 | 27.4 | 30.8 |
| | 2 | 27.0 | 28.3 | 116 | ○ (100%) | 28.5 | 28.2 | 31.1 |

(Charpy Impact Test)

In the Charpy impact test, JIS Z 2202:2005 2-mm U-notched test specimens were produced, and the test was performed at room temperature to measure the Charpy impact value (hereinafter referred to as "impact value"). Whether or not the impact value satisfied the required value of 30 J/cm$^2$ or less was assessed.

TABLE 3

| | | Amount of age hardening (HRC) | Amount of strain age hardening (HRC) | Total amount of hardening (HRC) | Proof stress (MPa) | Impact value (J/cm$^2$) | Aging conditions | Strain aging conditions |
|---|---|---|---|---|---|---|---|---|
| Example | 1 | 4.9 | 2.4 | 7.3 | 1023 | 52.1 | 625° C.-2 Hr | 400° C.-15% |
| | 2 | 4.6 | 2.3 | 6.9 | 1188 | 59.3 | 625° C.-2 Hr | 400° C.-15% |
| | 3 | 10.6 | 2.5 | 13.1 | 1493 | 72.1 | 625° C.-2 Hr | 400° C.-15% |
| | 4 | 3.0 | 2.4 | 5.4 | 1214 | 57.8 | 625° C.-2 Hr | 400° C.-15% |
| | 5 | 3.8 | 2.6 | 6.4 | 1254 | 36.3 | 625° C.-2 Hr | 400° C.-15% |
| | 6 | 3.5 | 2.2 | 5.7 | 1369 | 31.0 | 625° C.-2 Hr | 400° C.-15% |
| | 7 | 5.4 | 3.3 | 8.7 | 1091 | 33.9 | 625° C.-2 Hr | 400° C.-15% |
| | 8 | 3.2 | 3.4 | 6.6 | 1242 | 42.5 | 625° C.-2 Hr | 400° C.-15% |
| | 9 | 2.2 | 3.2 | 5.4 | 1216 | 51.9 | 625° C.-2 Hr | 400° C.-15% |
| | 10 | 4.8 | 2.7 | 7.5 | 1066 | 32.4 | 625° C.-2 Hr | 400° C.-15% |
| | 11 | 3.6 | 3.3 | 6.9 | 1438 | 32.8 | 625° C.-2 Hr | 400° C.-15% |
| | 12 | 3.7 | 2.6 | 6.3 | 1330 | 4.4 | 625° C.-2 Hr | 400° C.-15% |
| | 13 | 10.6 | 3.0 | 13.6 | 1513 | 4.2 | 625° C.-2 Hr | 400° C.-15% |
| | 14 | 6.1 | 3.1 | 9.2 | 1239 | 6.7 | 625° C.-2 Hr | 400° C.-15% |
| | 15 | 7.9 | 3.2 | 11.1 | 1515 | 4.0 | 625° C.-2 Hr | 400° C.-15% |
| | 16 | 2.2 | 2.8 | 5.0 | 1041 | 21.0 | 675° C.-2 Hr | 400° C.-15% |
| | 17 | 5.0 | 3.3 | 8.3 | 1177 | 14.0 | 625° C.-2 Hr | 400° C.-15% |
| | 18 | 6.1 | 3.0 | 9.1 | 1323 | 7.0 | 625° C.-2 Hr | 400° C.-15% |
| | 19 | 6.5 | 3.0 | 9.5 | 1008 | 22.0 | 625° C.-2 Hr | 400° C.-15% |
| | 20 | 5.2 | 2.8 | 8.0 | 1253 | 14.0 | 625° C.-2 Hr | 400° C.-15% |
| | 21 | 6.7 | 3.0 | 9.7 | 960 | 4.0 | 625° C.-2 Hr | 400° C.-15% |
| | 22 | 4.5 | 2.9 | 7.4 | 1117 | 4.0 | 625° C.-2 Hr | 400° C.-15% |
| | 23 | 3.9 | 3.4 | 7.3 | 1014 | 23.0 | 600° C.-2 Hr | 400° C.-15% |
| | 24 | 7.5 | 3.5 | 11.0 | 1359 | 19.0 | 600° C.-2 Hr | 400° C.-15% |
| | 25 | 6.5 | 3.3 | 9.8 | 1399 | 21.0 | 600° C.-2 Hr | 400° C.-15% |
| | 26 | 3.9 | 2.8 | 6.7 | 1243 | 20.0 | 550° C.-2 Hr | 400° C.-15% |
| | 27 | 6.1 | 3.5 | 9.6 | 1428 | 10.0 | 625° C.-2 Hr | 400° C.-15% |
| | 28 | 3.7 | 3.1 | 6.8 | 1046 | 6.0 | 600° C.-2 Hr | 400° C.-15% |
| | 29 | 6.4 | 3.0 | 9.4 | 1465 | 12.0 | 625° C.-2 Hr | 400° C.-15% |
| | 30 | 5.8 | 2.9 | 8.7 | 1345 | 19.0 | 625° C.-2 Hr | 400° C.-15% |
| | 31 | 2.4 | 3.2 | 5.6 | 962 | 11.0 | 625° C.-2 Hr | 400° C.-15% |
| | 32 | 2.0 | 3.0 | 5.0 | 1176 | 19.0 | 625° C.-2 Hr | 400° C.-15% |
| | 33 | 5.1 | 3.4 | 8.5 | 1283 | 15.0 | 625° C.-2 Hr | 400° C.-15% |
| | 34 | 1.9 | 3.1 | 5.0 | 1097 | 23.0 | 625° C.-2 Hr | 400° C.-15% |
| | 35 | 3.7 | 3.1 | 6.8 | 1122 | 5.0 | 625° C.-2 Hr | 400° C.-15% |

TABLE 3-continued

| | | Amount of age hardening (HRC) | Amount of strain age hardening (HRC) | Total amount of hardening (HRC) | Proof stress (MPa) | Impact value (J/cm$^2$) | Aging conditions | Strain aging conditions |
|---|---|---|---|---|---|---|---|---|
| | 36 | 5.0 | 3.4 | 8.4 | 1297 | 9.0 | 625° C.-2 Hr | 400° C.-15% |
| | 37 | — | — | 6.9 | 1255 | 44.4 | 625° C.-2 Hr | 400° C.-15% |
| | 38 | — | — | 10.9 | 1507 | 5.0 | 625° C.-2 Hr | 400° C.-15% |
| | 39 | — | — | 7.8 | 1135 | 5.0 | 625° C.-2 Hr | 400° C.-15% |
| Comparative | 1 | −0.4 | 3.4 | 3.0 | 791 | 76.8 | 625° C.-2 Hr | 400° C.-15% |
| Example | 2 | 5.6 | 3.2 | 8.8 | 896 | 48.0 | 625° C.-2 Hr | 400° C.-15% |
| | 3 | 6.9 | 2.9 | 9.8 | 878 | 55.0 | 625° C.-2 Hr | 400° C.-15% |
| | 4 | 1.5 | 3.0 | 4.5 | 897 | 85.0 | 625° C.-2 Hr | 400° C.-15% |
| | 5 | 2.6 | 2.8 | 5.4 | 1347 | 33.0 | 625° C.-2 Hr | 400° C.-15% |
| | 6 | 2.2 | 3.2 | 5.4 | 1512 | 37.0 | 625° C.-2 Hr | 400° C.-15% |
| Reference | 1 | −0.2 | 3.4 | 3.2 | 821 | 50.0 | 480° C.-2 Hr | 400° C.-15% |
| Example | 2 | −0.3 | 2.9 | 2.6 | 834 | 64.0 | 720° C.-2 Hr | 400° C.-15% |

Furthermore, in order to determine a working temperature range and a reduction ratio range which were effective for the amount of hardening due to the strain age hardening treatment (step S5), test specimens of FIG. 2 produced from the steel material of Example 1 were used to examine a relationship between working temperature in the treatment performed at a reduction ratio of 15% and hardness, and to further examine a relationship between reduction ratio in the treatment performed at a working temperature of 400° C. and hardness.

Additionally, separately from the production pattern (process 1) in which, as described above, after the completion of the age hardening treatment (heat treatment+air-cooling to room temperature), the strain age hardening treatment (step S5) was performed, a production pattern (process 2) in which the strain age hardening treatment (step S5) at a reduction ratio of 15% was performed at the time when the temperature reached 400° C. during cooling just after the completion of the heat treatment in the age hardening treatment, was performed.

In Table 2 and Table 3 are shown the results of calculations of the left side of each of expressions (1) to (3) for the various steels (Examples 1 to 39, Comparative Examples 1 to 6, and Reference Examples 1 and 2) and the results of the measurements. Among Examples 1 to 39, Examples 1 to 36 correspond to the above-described process 1, and Examples 37 to 39 correspond to the above-described process 2. The chemical compositions of the steel materials in Examples 37 to 39 were the same as those in Examples 8, 15 and 22, respectively. In contrast to Examples 1 to 36, since a hardness after aging could not be measured in Examples 37 to 39, "Hardness after aging" in Table 2 and "Amount of age hardening" and "Amount of strain age hardening" in Table 3 of these Examples are showed as "-".

As shown in Examples 1 to 36, by regulating the composition so that the contents of chemical components are within the predetermined ranges and that the composition satisfies expressions (1) and (2), an age hardening type bainitic microalloyed steel which attains even higher strength is obtained. Specifically, it is possible to obtain a steel which attains an areal proportion of bainite of 85% or higher, a hardness after an age hardening treatment of 30 HRC or higher, and a hardness after a strain age hardening treatment of 33 HRC or higher and in which the hardness after the strain age hardening treatment is higher by at least 2 HRC than the hardness after the age hardening treatment and the hardness after the strain age hardening treatment is higher by at least 5 HRC than the hardness before the age hardening treatment, and which comes to have a proof stress of 900 MPa or higher. Use of this steel material, in turn, makes it possible to obtain a part having those properties. Meanwhile, Examples 12 to 36 are steel materials which further satisfy the component content ranges represented by expression (3), and these steel materials each have not only even higher strength after the strain age hardening treatment, but also have a low toughness value. Specifically, the Charpy impact values (2-mm U) at room temperature thereof are 30 J/cm$^2$ or less.

Additionally, the proof stress and impact value obtained in Examples 37 to 39 were the same level as those obtained in the corresponding Examples 8, 15 and 22, respectively.

Meanwhile, Comparative Example 1 had a hardness after the age hardening treatment of less than 30 HRC (26.7 HRC), a hardness after the strain age hardening treatment of less than 33 HRC (30.1 HRC), and a proof stress of less than 900 MPa (791 MPa), because this steel material did not satisfy expression (2). Comparative Example 2, although satisfying expressions (1) and (2), had a C content lower than the lower limit of 0.10%. Because of this, the proof-stress-improving effect of C through the strain age hardening treatment was not sufficiently obtained and, hence, the proof stress was less than 900 MPa (896 MPa), although a hardness after the strain age hardening treatment was higher than 33 HRC (33.7 HRC). Comparative Example 3 did not satisfy expression (2) and, hence, had a hardness after the strain age hardening treatment of less than 33 HRC (32.1 HRC) and a proof stress of less than 900 MPa (878 MPa), like Comparative Example 1.

Comparative Example 4 did not satisfy expression (1) and hence had an areal proportion of bainite of less than 85% (areal proportion of bainite: 70%), a hardness after the age hardening treatment of less than 30 HRC (28.9 HRC) due to the formation of ferrite structures, a hardness after the strain age hardening treatment of less than 33 HRC (31.9 HRC), and a proof stress of less than 900 MPa (897 MPa).

Comparative Example 5 had bainite/martensite mixed structures because the Mn content exceeded the upper limit of 3.00% (3.500/o). Comparative Example 6 had bainite/martensite mixed structures because the Cr content exceeded the upper limit of 3.00% (3.40%). These steels each attained high strength after the strain age hardening treatment but were poor in machinability because of the martensite intermingled with the bainite.

Reference Examples 1 and 2 show the following. Even in cases when the contents of chemical components were in the predetermined ranges and expressions (1) to (3) were satisfied, use of aging temperatures outside the range of 500-700° C. (Reference Example 1, 480° C.; Reference Example 2, 720° C.) resulted in hardnesses after the age hardening treatment of less than 30 HRC (Reference Example 1, 27.4 HRC; Reference Example 2, 28.2 HRC), hardnesses after the strain age hardening treatment of less than 33 HRC (Reference Example 1, 30.8 HRC; Reference Example 2, 31.1 HRC), and proof stresses of less than 900 MPa (Reference Example 1, 821 MPa; Reference Example 2, 834 MPa).

Figure 3:
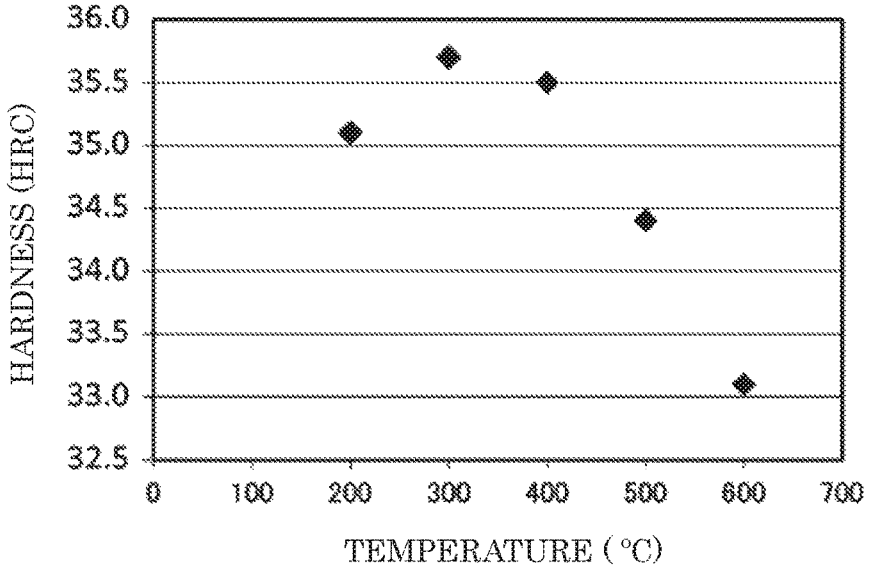
FIG. 3 is a graph which shows a relationship between working temperature in the strain age hardening treatment and hardness.

A relationship between working temperature and hardness is shown in FIG. 3, and a relationship between reduction ratio and hardness is shown in FIG. 4. In the Examples, the various tests, etc. were conducted after a strain aging treatment was conducted in which the working temperature was set at 400° C. or the reduction ratio was set at 15%. As apparent from FIG. 3 and FIG. 4, it can be sufficiently presumed that so long as the working temperature is in the range of 200-600° C. and the reduction ratio is in the range of 3-35%, a hardness after the strain age hardening treatment of 33 HRC or higher is attained.

As apparent from the explanations given above, parts obtained from the age hardening type bainitic microalloyed steel according to the present invention can have even higher strength. Consequently, when the present invention is applied to, for example, connecting rods for vehicles, a reduction in part size can be attained. Furthermore, in cases when the steel material in which the contents of components are in predetermined ranges (satisfy all of expressions (1) to (3)) is applied to the present invention to produce parts, the parts can have not only even higher strength but also low toughness value. Consequently, even in the case of applying these parts to cracking connecting rods, a reduction in part size can be attained.

Additionally, effect of enhancing the strength can be obtained at the same level in both the process 1 in which the strain age hardening treatment was performed after the age hardening treatment (heat treatment+air-cooling to room temperature) and the process 2 in which the strain age hardening treatment was performed during cooling just after the completion of the heat treatment in the age hardening treatment. Furthermore, in the process 2, a period required for the entire production process can be shortened. Accordingly, in the process for producing a part from an age hardening type bainitic microalloyed steel according to the present invention, it is sufficient that "age hardening treatment step" includes at least the heat treatment of the age hardening treatment.

The present invention can be carried out in variously modified modes without departing from the gist of the present invention. For example, the present invention can be applied to not only a part having a first portion which has undergone both an age hardening treatment and a subsequent strain age hardening treatment and a second portion which has not undergone any strain age hardening treatment after the age hardening treatment, but also a part in which all the portions that underwent an age hardening treatment have been subjected to a strain age hardening treatment. In the case of the former, it is possible to obtain a part in which the second portion has a hardness of 30 HRC or higher, the first portion has a hardness of 33 HRC or higher, and the hardness of the first portion is higher than the hardness of the second portion by 2 HRC or more, namely, a part in which only the portion required to have strength has been made to have higher strength. Meanwhile, in the case of the latter, it is possible to obtain a part in which all the portions have a hardness of 33 HRC or higher. The present application is based on Japanese Patent Application No. 2015-196645 filed on Oct. 2, 2015 and Japanese Patent Application No. 2016-160290 filed on Aug. 18, 2016, and the contents are incorporated herein by reference.

DESCRIPTION OF REFERENCE NUMERALS AND SIGNS

10 Test specimen
11, 12 Cut surface
S1 Melting
S2 Forging
S3 Non-thermal-refining forging
S4 Age hardening treatment
S5 Strain age hardening treatment

What is claimed is:

1. A process for producing a part from an age hardening type bainitic microalloyed steel, the age hardening type bainitic microalloyed steel comprising, in terms of mass %:

0.10-0.40% of C;
0.01-2.00% of Si;
0.10-3.00% of Mn;
0.001-0.150% of P;
0.001-0.200% of S;
0.001-2.00% of Cu;
up to 0.40% of Ni;
0.10-3.00% of Cr; and
at least one selected from:
0.02-2.00% of Mo;
0.02-2.00% of V;
0.001-0.250% of Ti; and
0.010-0.100% of Nb,
with the remainder being Fe and unavoidable impurities, and satisfying the following expression (1) and expression (2), the process comprising:

a non-thermal-refining forging step of subjecting the age hardening type bainitic microalloyed steel to hot forging;

an age hardening treatment step of subjecting the age hardening type bainitic microalloyed steel after the hot forging to age hardening treatment at a predetermined aging temperature within a range of 500-700° C.; and a strain age hardening treatment step of subjecting the age hardening type bainitic microalloyed steel during or after the age hardening treatment to strain age hardening treatment at a predetermined working temperature that is lower than the aging temperature and is within a range of 200-600° C. and at a reduction ratio of 3-35%:

$$3\times[C]+10\times[Mn]+2\times[Cu]+2\times[Ni]+12\times[Cr]+9\times[Mo]+2\times[V]>20 \quad \text{expression (1);}$$

$$32\times[C]+3\times[Si]+3\times[Mn]+2\times[Ni]+3\times[Cr]+11\times[Mo]+32\times[V]+65\times[Ti]+36\times[Nb]>24.0 \quad \text{expression (2),}$$

in which each [ ] in the expression (1) and the expression (2) indicates a content of the element shown therein in terms of mass %.

2. The process for producing a part from an age hardening type bainitic microalloyed steel according to claim 1, wherein the age hardening type bainitic microalloyed steel further satisfies the following expression (3):

$$321\times[C]-31\times[Mo]+213\times[V]+545\times[Ti]+280\times[Nb]>100 \quad \text{expression (3),}$$

in which each [ ] in the expression (3) indicates a content of the element shown therein in terms of mass %.

3. The process for producing a part from an age hardening type bainitic microalloyed steel according to claim 1, wherein the age hardening type bainitic microalloyed steel further comprises, in terms of mass %, at least one selected from:

0.0001-0.0100% of B;
0.001-0.300% of Pb;
0.001-0.300% of Bi;
0.001-0.300% of Te; and
0.001-0.010% of Ca.

4. The process for producing a part from an age hardening type bainitic microalloyed steel according to claim 2, wherein the age hardening type bainitic microalloyed steel further comprises, in terms of mass %, at least one selected from:

0.0001-0.0100% of B;
0.001-0.300% of Pb;
0.001-0.300% of Bi;
0.001-0.300% of Te; and
0.001-0.010% of Ca.

5. A part obtained by the process for producing a part from an age hardening type bainitic microalloyed steel according to claim 1.

6. A part obtained by the process for producing a part from an age hardening type bainitic microalloyed steel according to claim 2.

7. A part obtained by the process for producing a part from an age hardening type bainitic microalloyed steel according to claim 3.

8. A part obtained by the process for producing a part from an age hardening type bainitic microalloyed steel according to claim 4.

* * * * *